United States Patent [19]

Morey

[11] Patent Number: 5,054,703

[45] Date of Patent: Oct. 8, 1991

[54] STUMP CHIPPER KNIFE ASSEMBLY

[75] Inventor: Norval Morey, Winn, Mich.

[73] Assignee: Wood Technology, Inc., Winn, Mich.

[21] Appl. No.: 597,548

[22] Filed: Oct. 12, 1990

[51] Int. Cl.[5] ..... B02C 7/12; B27C 1/00

[52] U.S. Cl. ..... 241/296; 144/176; 144/241; 241/92; 241/291; 407/39; 407/47

[58] Field of Search ..... 241/92, 101.7, 278 R, 241/278 A, 291, 296, 298; 144/176, 102 R, 241

[56] References Cited

U.S. PATENT DOCUMENTS

| | | | |
|---|---|---|---|
| 4,736,781 | 4/1988 | Morey et al. | 241/298 |
| 4,771,953 | 9/1988 | Morey . | |
| 4,958,775 | 9/1990 | Arsmith | 144/241 |

*Primary Examiner*—W. Donald Bray

*Attorney, Agent, or Firm*—Warner, Norcross & Judd

[57] ABSTRACT

A chipper knife assembly for a stump disintegrator is disclosed in which knife holder bodies radially span across pockets or openings formed in a rotating chipper disk. A reversible and replaceable blade insert with a plurality of selectable carbide edges is carried on the leading face of the holder body and fixed thereon by means of a threaded fastener inserted from the trailing face of the holder body through a hole formed between the trailing face and the leading face. The end of the fastener engages a threaded recess in the blade insert. The chipper knife assembly divides the chipper disk opening into a leading opening through which wood chips and other debris may pass for subsequent discharge and a leading opening which provides clearance and access to the threaded fastener for its removal and installation.

16 Claims, 3 Drawing Sheets

STUMP CHIPPER KNIFE ASSEMBLY

BACKGROUND OF THE INVENTION

1. Field of the Invention

The present invention relates to stump and wood chipping disintegrators and more particularly to a knife assembly for such disintegrators.

2. Description of the Related Art

Clearing of wooded terrain for building construction or highway purposes has been greatly aided by the development of practical chipping equipment. The trunks, limbs and tops of trees and brush can be chipped for fuel, paper manufacturing, chipboard fabrication and other uses. Alternatively, tree trunks can be separated for making lumber and plywood, while the branches and tops are chipped for fuel or the like.

The tree stumps, however, are not as readily processed or disposed of as the upper portions of the trees. Stumps are extremely difficult to chip and destructive of machinery. Often there are stones lodged in the roots in addition to large quantities of dirt. The stump wood itself has roots extending in many directions and possessing differing grain patterns.

Recently, machines have been developed for the effective chipping or disintegrating of stumps, as exemplified by the disclosure of U.S. Pat. No. 4,736,781, issued Apr. 12, 1988, and entitled "Stump Disintegrator." Briefly described, the apparatus shown therein has a trough forming a stump support, a chipping disk at one end of the trough with chipping blades projecting from the face of the disk at varying radial distances from the rotational axis of the disk, and a driven ram plate at the other end of the trough for forcing stumps toward the disk. The chipping disk is provided with a plurality of openings or pockets in which the chipping blades are carried.

The chipping blades of U.S. Pat. No. 4,736,781 comprise rather complex assemblies of replaceable carbide knife blade inserts carried on special blade holders. The holders include an outer holder body with peripheral holes for bolting the holders to the rear face of the chipping disk so that the holders extend through the pockets. The carbide blade is dovetailed into the holder. In order to firmly hold the blade in place and allow for its adjustment, there is an arrangement of a wedge, a differential threaded fastener, a stop screw, an inner holder member, and a fastener bolt. Each of these several parts is subject to wear and damage.

Therefore, there is a heretofore unmet need for a stump chipper knife assembly which is of simple and economical construction and which is easily maintained.

SUMMARY OF THE INVENTION

The present invention meets the aforementioned need by providing a stump chipper knife assembly including a unitary holder body which may be welded in place in openings or pockets formed in a chipping disk, and which has a leading face carrying a reversible and replaceable blade insert. The holder body has a hole extending between the trailing and leading faces. A cap screw or other suitable fastener is inserted from the trailing face through the hole to engage a threaded hole or recess formed in the blade insert. The openings in the chipping disk are formed such that there are openings forward of the leading face of the holder body and rearward of the trailing face of the holder body. The forward openings allow the passage of chips through the disk for subsequent discharge from the chipper. The rearward openings provide clearance and access to the cap screw or other suitable fastener so that the fastener may be inserted or removed for changing or reversing the blade insert.

The blade insert of the invention provides for economical renewal of the cutting edges of the stump chipper knife assembly. Each insert includes a plurality of carbide-tipped cutting edges. When a cutting edge is dulled, a new edge is installed by simply loosening the fastener, replacing the old insert with a new one or reversing the old insert to select a fresh edge, and retightening the fastener.

According to another feature of the invention, the holder bodies of the stump chipper knife assemblies are provided with side extensions which mate with similarly formed side cutouts in the chipper disk openings. The rearward surface of the side extensions cooperate with the cutouts to bear the thrust forces generated as the blades strike the stumps. In yet another aspect, the side extensions are provided with lips which bear against the inner face of the chipper disk to seat the holder bodies in the openings and to provide a portion of the holder bodies for welding to the disk.

These and other objects, advantages, and features of the present invention will be more fully understood and appreciated by reference to the written specification and appended drawings.

DESCRIPTION OF THE PREFERRED EMBODIMENT

Figure 1:
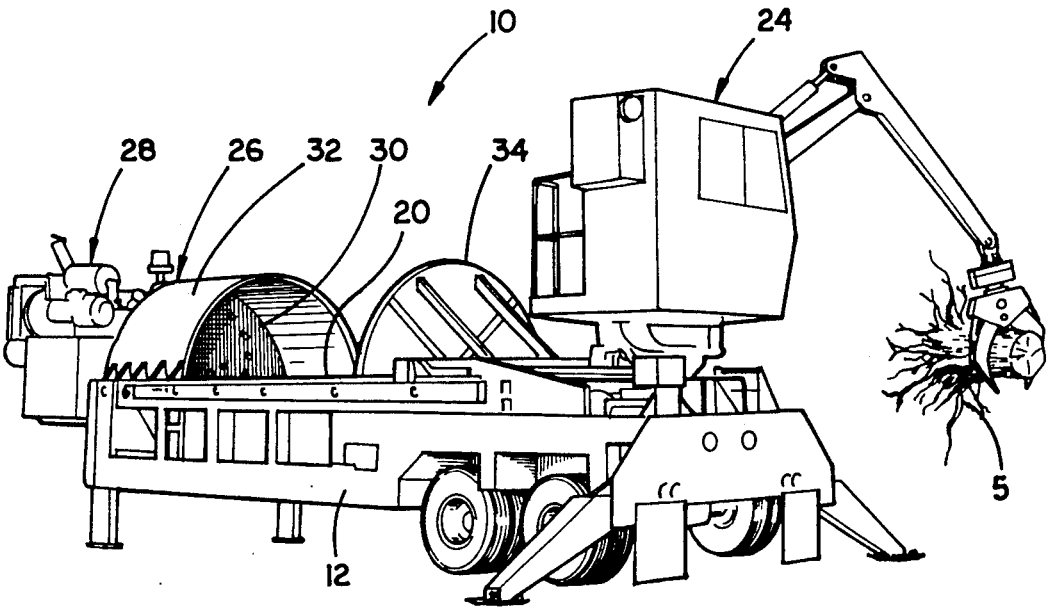
FIG. 1 is a perspective view of a stump chipping disintegrator including stump chipper knife assemblies according to the principles of the present invention.

By way of disclosing a preferred embodiment, and not by way of limitation, there is shown in FIG. 1 a stump and wood chipping disintegrator 10 in which are installed chipper knife assemblies according to the principles of the present invention. Similar disintegrators are disclosed in the aforementioned U.S. Pat. Nos. 4,736,781, and in 4,771,953, issued Sept. 20, 1988, and entitled "Retractable Anvil Chipper." Both of these patents are incorporated herein by reference.

In a manner known to those skilled in the art, the disintegrator includes a frame 12 which comprises the bed of a truck trailer, and a semicylindrical stump support trough 20 extending in the axial direction of the trailer. This trough has an open top for receiving stumps S, large chunks of tree trunks or the like. These are placed in the trough by a hoist or crane 24 mounted on the frame.

At the front of the trough 20 there is a chipper subassembly 26 operated by a drive motor 28. The motor drivingly rotates a chipper disk assembly 30 mounted within a cowl 32. A ram 34 is provided at the rear of the trough to force the stumps and other matter against the front face of the chipper disk assembly 30.

Figure 2:
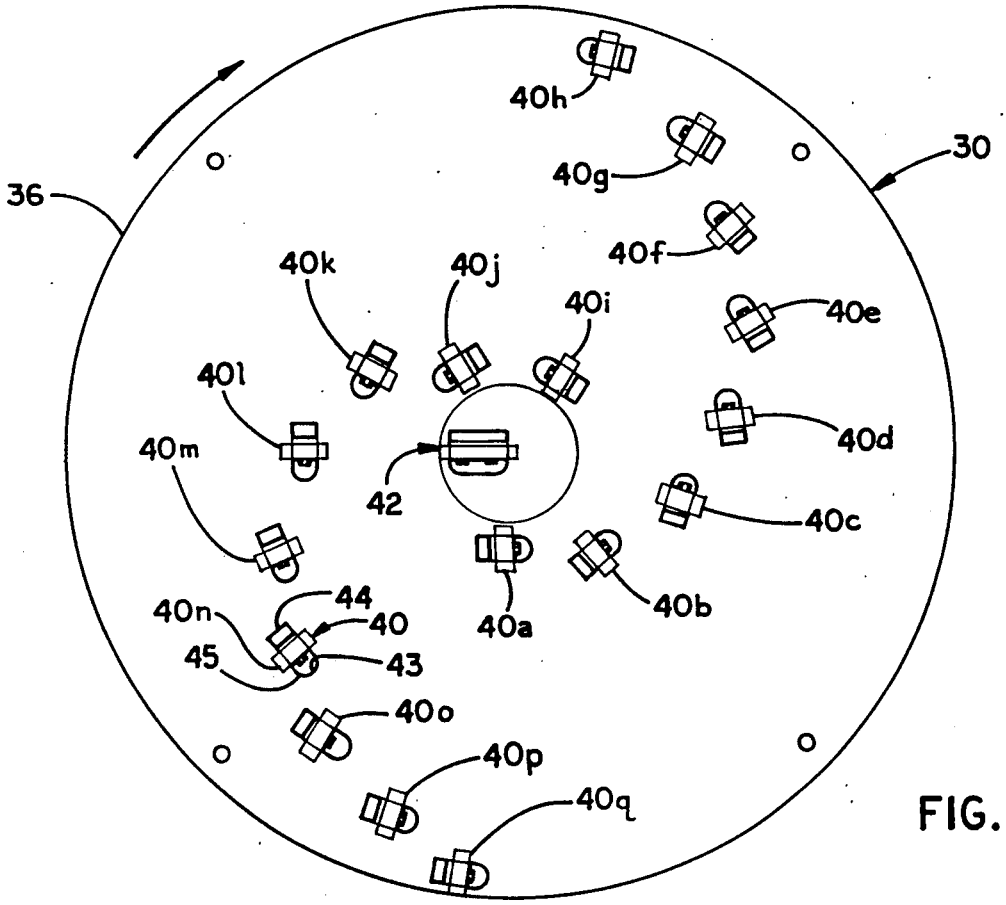
FIG. 2 is a front elevational view of the chipper disk and knife assemblies of the disintegrator of FIG. 1.

Additional details of the chipper disk assembly 30 are shown in FIG. 2. The assembly includes a circular chipper disk plate 36 and several chipper knife assemblies designated generally at 40 and arranged at various radial distances along two spiral lines of individual chipper knife assemblies 40*a*–40*h* and 40*i*–40*j*. The assemblies 40*i*–40*q* are radially offset relative to the blades in the first series 40*a*–40*h* so as to match the spaces therebetween. As is known in the art, this arrangement of the chipper knife assemblies is provided so that every radial portion of the disk will have a cutting blade somewhere around its circumference.

Adjacent the center of the chipper disk plate 36 there is an alternate embodiment of the chipper knife assembly 42. Assembly 42, more fully described below, is similar to assembly 40 but is radially wider and specially adapted for use near the center of the disk.

Each chipper knife assembly 40 is received in a pocket or opening 43 formed through the chipper disk plate 36. Each knife assembly radially spans across the openings 43 thereby forming a leading opening 44 through which wood chips and other debris may pass for subsequent discharge and a trailing opening 45 which provides clearance and access to the chipper blade retaining means, as more fully described below.

Referring to FIGS. 3–6, additional details of the chipper knife assemblies 40 and of the chipper disk plate 36 may be seen. Each knife assembly 40 includes a holder body 46, a chipping blade insert 48, a cap screw fastener 50 and a lock washer 52.

The holder body 46, preferably formed of a unitary piece of steel, includes a central portion 54 and two outer portions 56, 58 extending laterally, radially outwardly from the ides of the central portion 54. The central portion 54 has a generally forwardly directed leading face 60 and a rearwardly directed trailing face 62 spaced apart from the leading face 60. The leading face 60 is inclined forwardly at an angle of approximately 11 degrees. The lower surfaces of the central portion 54 and outer portions 56, 58 are flush, while the upper surface of the central portion is raised above the upper surfaces of the outer portions. A hole 64 is formed through the central portion 54 of the holder body extending between the leading face 60 and the trailing face 2. Along the lower extents of the outer faces of the outer portions 54, 56 of the holder body, and extending outwardly therefrom, there are narrow lips 66, 68.

The chipper blade inserts 48 each include a rectangular plate 70 having two carbide blade edges 72 secured in recesses formed along diagonally opposite major edges of the plate 70. A threaded recess or hole 74 is formed through the center of the plate extending between the two major surfaces of the plate. The axis of the hole 74 is inclined at angle to the major surfaces of the insert to match the angle of inclination of the leading face 60 of the holder body 46. When assembled, the blade insert 48 is placed over the leading face 60 with the holes 74 and 64 in alignment. The threaded shank of cap screw 50 is inserted from the trailing face 62 of the holder body through the lock washer 52 and hole 64 and forward to engage the threads in hole 74. The cap screw, when tightened, firmly holds the blade insert 48 in place on the leading face 60. The end of the threaded shank does not extend beyond the leading face of the blade insert. Inner side walls 76, 78 (FIG. 6) of the holder body outer portions 66, 68 extend slightly forwardly beyond the leading face 60 and serve to capture the blade insert laterally and to prevent the blade insert from rotating when the cap screw is turned.

Figure 3:
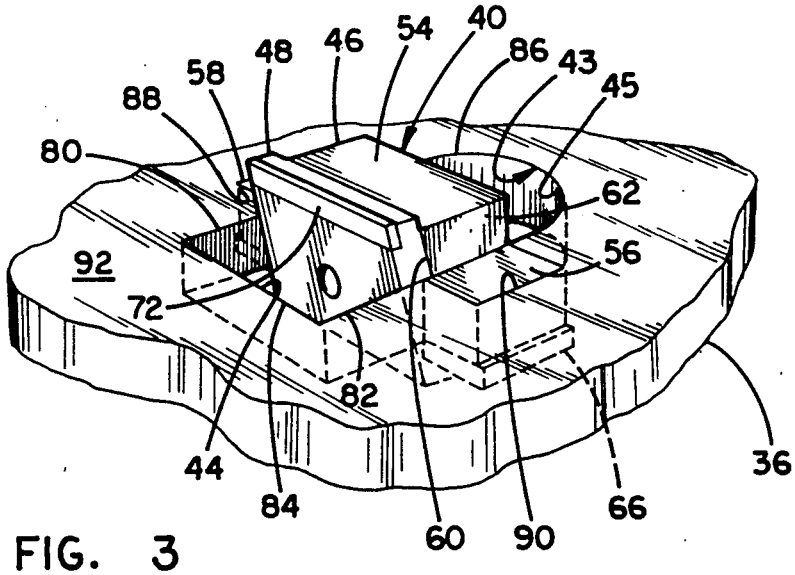
FIG. 3 is a fragmentary perspective view of a stump chipper knife assembly installed in a chipper disk opening.
Figure 5:
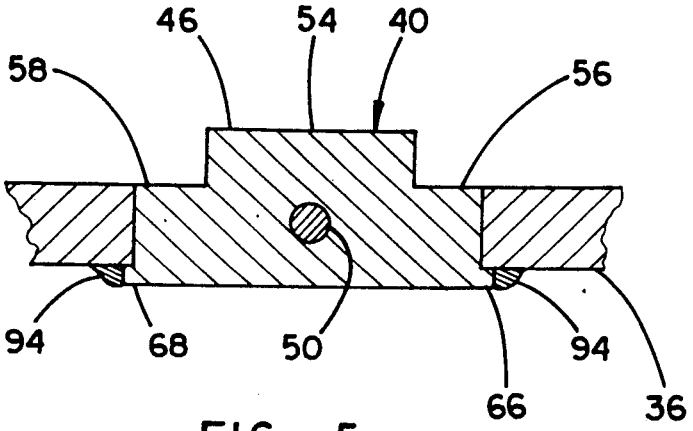
FIG. 5 is a sectional view taken along the line 5—5 of FIG. 4.
Figure 4:
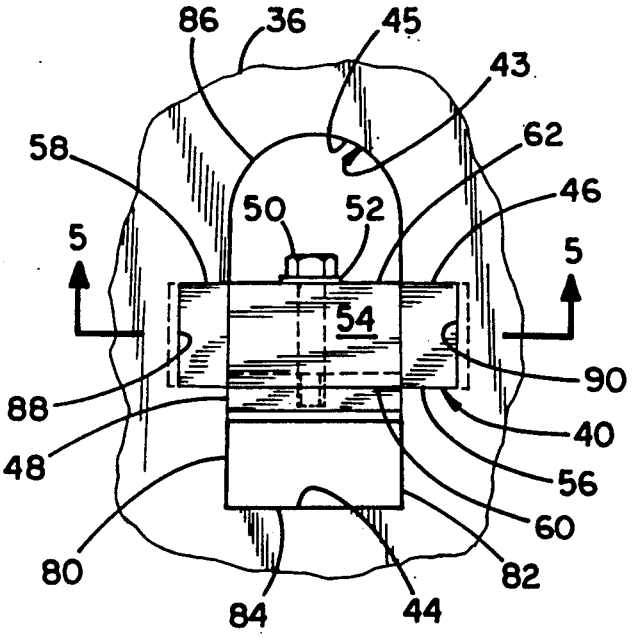
FIG. 4 is a top fragmentary view thereof.

As shown in FIGS. 3 and 4, the openings 43 formed in the disk plate 36 are generally elongated in the circumferential direction, and are bounded by two spaced apart and parallel lateral sides 80, 82, a leading side 84, and a generally semicircular trailing side 86. Along the central portions of the lateral sides 80, 82 there are formed radially extending recesses 88, 90 which correspond in size in shape to the outer portions 56, 58 of the holder bodies 46.

A chipper knife assembly 40 is installed in each opening 43 spanning across the opening lateral sides 80, 82 with the holder body outer portions 56, 58 being received in the recesses 88, 90. As shown also in FIG. 5, the lips 66, 68 bear against the underside of the disk 36 such that the upper or outer surfaces of the outer portions are flush with the upper or outer surface 92 of the disk 36. The central portion 54 of the holder body extends upwardly or outwardly beyond the disk surface 92 so that the carbide blade 72 protrudes sufficiently to provide chipping action. The chipper knife assemblies are preferably fixed to the chipper disk 36 by welding, such as by fillet welds 94 at the juncture of the lower portion of the holder body to the underside of the disk.

When the cutting edge of a chipper blade insert 48 requires renewal, it is merely necessary to loosen cap screw 50 and either reverse the insert to present a fresh carbide blade 72 or install a new insert. The trailing opening 44 provides access to the cap screw and clearance for its removal and the use of a wrench.

Figure 7:
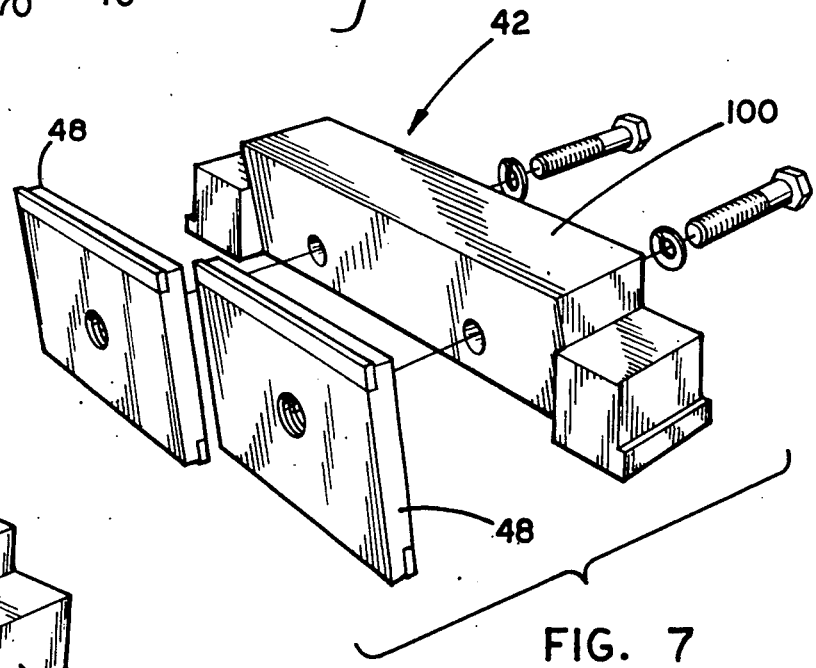
FIG. 7 is an exploded perspective view of a first alternate embodiment of the chipper knife assembly.

An alternate embodiment of the chipper blade assembly 42 is shown in FIG. 7. This embodiment is similar to the assembly 40, except that the central body portion 100 is doubled in width in the radial direction so that two blade inserts 48 are carried side by side in radially lateral adjacency on the leading face 102. Two sets of holes, cap screws and lock washers are provided. Alternatively, a single, elongated blade insert may be used.

Figure 6:
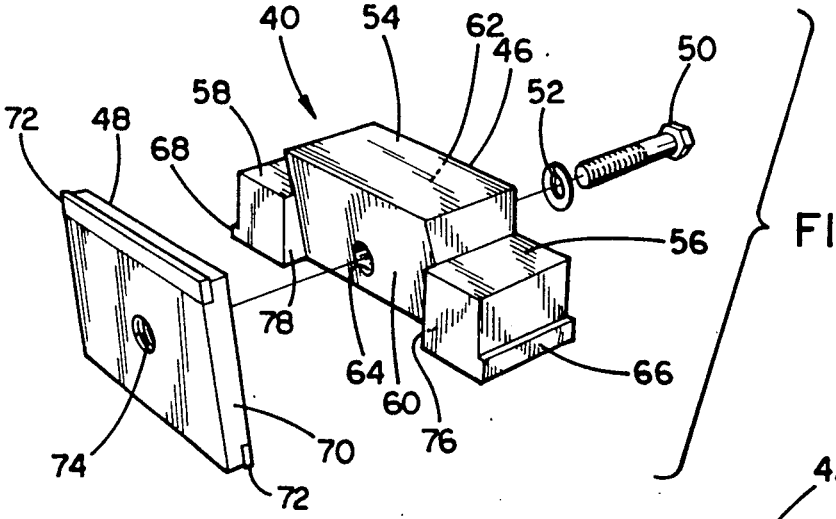
FIG. 6 is an exploded perspective view of the stump chipper knife assembly.
Figure 8:
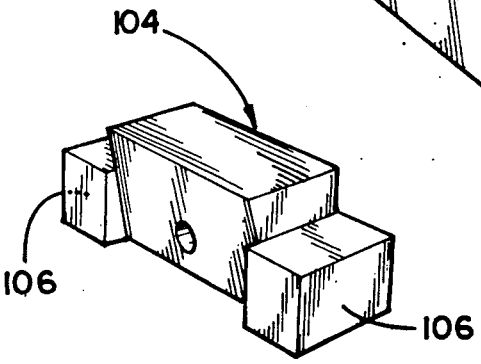
FIG. 8 is a perspective view of a second alternative embodiment of the holder body of the stump chipper knife assembly.

FIG. 8 shows a further alternate embodiment of the holder body 104 in which the outer end faces 106 of the outer body portions are flat rather than having the lips of the embodiment shown in FIG. 6. With this embodiment, the thickness of the outer body portions may be made equal to the thickness of the disk plate such that the underside of the assembled disk will be substantially flush.

The above description is that of a preferred embodiment of the invention. Various alterations and changes can be made without departing from the spirit and broader aspects of the invention as set forth in the appended claims, which are to be interpreted in accordance with the principles of patent law, including the Doctrine of Equivalents.

The embodiments of the invention in which an exclusive property or privilege is claimed are defined as follows:

1. A knife assembly for a chipping disintegrator of the type having a drivingly rotated chipping disk comprising:

a unitary holder body adapted to be carried within an opening formed through the chipping disk disposed spanning radially across said opening, said holder body including a central portion having a leading face, a trailing face spaced apart from said leading face, and a hole formed therethrough extending between said leading face and said trailing face;

a cutting blade insert carried directly on said leading face; and fastener means extending through said hole engaging said cutting blade insert and fixing said insert to said leading face.

2. The knife assembly of claim 1 wherein said blade insert includes a plurality of selectable cutting edges.

3. The knife assembly of claim 1 further comprising a plurality of blade inserts fixed to said leading face disposed in radially lateral adjacency.

4. The knife assembly of claim 1 wherein said cutting blade insert has a recess formed therein disposed in axial alignment with said hole formed through said body, and wherein said fastener means engages said blade insert recess.

5. In a chiping disintegrator of the type including a drivingly rotating disk having an outer face and an inner face and carrying at least one chipping knife projecting from the outer face of the disk and means for forcing stump waste material and the like into chipping contact with said chipping knife, the improvement comprising:

at least one opening formed through said disk, said opening having first and second radially spaced apart lateral sides, and circumferentially spaced apart leading and trailing sides;

a chipper knife assembly carried in said opening and spanning radially thereacross, said chipper knife assembly including:

a unitary holder body comprising a central portion having a leading face and a trailing face circumferentially rearwardly spaced apart from said leading face, said leading face spaced apart from said disk opening leading side and said trailing face spaced apart from said disk opening trailing side, said holder body having a hole formed therethrough extending between said leading face and said trailing face;

a readily removable and replaceably cutting blade insert carried directly on said leading face;

fastener means extending through said hole engaging said cutting blade insert and fixing said insert to said leading face.

6. The improvement of claim 5 further comprising a plurality of said blade inserts carried on said leading face disposed in radially lateral adjacency.

7. The improvement of claim 5 wherein said blade insert includes a plurality of selectable cutting edges.

8. The improvement of claim 7 wherein said cutting edges comprise carbide blades.

9. The improvement of claim 5 wherein said holder body includes a hole formed therethrough extending between said holder body trailing face and leading face, said blade insert comprises a plate including a threaded recess in axial alignment with said holder body hole, and wherein said fastener means comprises a readily removable fastener having a threaded shank inserted from said trailing face through said hole and engaging said threaded recess.

10. The improvement of claim 5 wherein the underside of said holder body is substantially flush with the inner face of said disk.

11. The improvement of claim 5 wherein said holder body includes radially spaced apart first and second ends and further comprises lips extending radially outwardly disposed along the lower extents of said ends, each of said lips bearing against the inner face of said disk.

12. The improvement of claim 12, further comprising welds disposed at the juncture of said lips and said inner face of said disk for fixing said chipper knife assembly to said chipper disk.

13. The improvement of claim 5 wherein said opening formed in said chipping disk includes first and second radially extending recesses formed in the central extents of said first and second lateral sides, respectively, and wherein radially spaced apart outer portions of said holder body are received within said first and second recesses.

14. The improvement of claim 13, wherein said outer portions of said holder body have outer surfaces disposed flush with said chipping disk outer face.

15. A stump chipping disintegrator comprising;

a drivingly rotated chipper disk having spaced apart outer and inner faces and at least one opening formed therethrough, said opening including radially spaced apart first and second lateral sides and circumferentially spaced apart leading and trailing sides;

means for forcing stumps toward said chipper disk;

at least one chipper knife assembly carried in said chipper disk opening and including:

a unitary holder body extending radially between said first and second lateral sides of said disk opening, said holder body having a circumferentially forwardly directed leading face and a circumferentially rearwardly directed trailing face spaced apart from said leading face thereby forming a leading opening between said leading face and said disk opening leading side and a trailing opening between said trailing face and said disk opening trailing side;

a replaceable blade insert carried directly on said leading face of said holder body fixed thereto and protruding from said outer face of said chipping disk; and readily releasible fastener means for replaceably fixing said blade insert on said leading face, said fastener means extending between said trailing face and said leading face;

whereby said trailing opening provides clearance and access to said fastener means for its removal and installation.

16. The stump chipping disintegrator of claim 15 further comprising a plurality of said blade inserts carried on said leading face disposed in radially lateral adjacency.

* * * * *

UNITED STATES PATENT AND TRADEMARK OFFICE

CERTIFICATE OF CORRECTION

PATENT NO. : 5,054,703

DATED : October 8, 1991

INVENTOR(S) : Norval Morey

It is certified that error appears in the above-identified patent and that said Letters Patent is hereby corrected as shown below:

Column 6, claim 12, line 15:
change "Claim 12" to --Claim 11--.

Signed and Sealed this

Thirtieth Day of March, 1993

*Attest:*

STEPHEN G. KUNIN

*Attesting Officer*

*Acting Commissioner of Patents and Trademarks*